US010425744B2

(12) United States Patent
Yoo

(10) Patent No.: US 10,425,744 B2
(45) Date of Patent: Sep. 24, 2019

(54) MICROPHONE AND MANUFACTURING METHOD THEREOF

(71) Applicants: HYUNDAI MOTOR COMPANY, Seoul (KR); KIA MOTORS CORPORATION, Seoul (KR)

(72) Inventor: Ilseon Yoo, Suwon-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 2 days.

(21) Appl. No.: 15/622,602

(22) Filed: Jun. 14, 2017

(65) Prior Publication Data

US 2018/0146299 A1 May 24, 2018

(30) Foreign Application Priority Data

Nov. 24, 2016 (KR) ..... 10-2016-0157567

(51) Int. Cl.

| | |
|---|---|
| ***H04R 25/00*** | (2006.01) |
| ***H04R 19/04*** | (2006.01) |
| *H04R 19/00* | (2006.01) |
| *H04R 31/00* | (2006.01) |
| *H04R 7/18* | (2006.01) |
| *H04R 7/06* | (2006.01) |

(52) U.S. Cl.

CPC ..... *H04R 19/04* (2013.01); *H04R 7/06* (2013.01); *H04R 7/18* (2013.01); *H04R 19/005* (2013.01); *H04R 31/003* (2013.01)

(58) Field of Classification Search

CPC . H04R 19/04; H04R 7/06; H04R 7/18; H04R 19/005; H04R 31/003; H04R 2201/003

USPC ..... 381/174

See application file for complete search history.

(56) References Cited

U.S. PATENT DOCUMENTS

| | | | | |
|---|---|---|---|---|
| 5,303,210 | A * | 4/1994 | Bernstein | G10K 9/12 367/181 |
| 5,452,268 | A | 9/1995 | Bernstein | |
| 7,466,834 | B2 * | 12/2008 | Ogura | B81B 7/0061 381/174 |
| 9,199,837 | B2 * | 12/2015 | Kasai | B81B 7/0016 |
| 2007/0058825 | A1 * | 3/2007 | Suzuki | H04R 19/005 381/174 |
| 2010/0289097 | A1 | 11/2010 | Weigold et al. | |
| 2016/0192082 | A1 * | 6/2016 | Uchida | H04R 19/005 257/416 |

FOREIGN PATENT DOCUMENTS

| | | | |
|---|---|---|---|
| JP | 4737720 | B2 | 8/2011 |
| KR | 10-2016-0052296 | A | 5/2016 |

* cited by examiner

*Primary Examiner* — Phylesha Dabney
(74) *Attorney, Agent, or Firm* — Brinks Gilson & Lione

(57) ABSTRACT

The present disclosure provides a microphone including: a substrate having an acoustic hole; a vibrating electrode disposed on the substrate; and a fixing layer disposed on the vibrating electrode, wherein a central portion of the fixing layer corresponding to the acoustic hole of the substrate is formed upwardly convex.

12 Claims, 10 Drawing Sheets

MICROPHONE AND MANUFACTURING METHOD THEREOF

CROSS-REFERENCE TO RELATED APPLICATION

The present application claims priority to and the benefit of Korean Patent Application No. 10-2016-0157567, filed on Nov. 24, 2016, which is incorporated herein by reference in its entirety.

FIELD

The present disclosure relates to a microphone and a manufacturing method thereof.

BACKGROUND

The statements in this section merely provide background information related to the present disclosure and may not constitute prior art.

Generally, a microphone, which converts a voice into an electrical signal, may be applied to various devices such as a mobile communication device, an earphone, a hearing aid, etc.

The microphone has been downsized, and microelectromechanical system (MEMS) microphones are being developed based on a microelectromechanical system (MEMS) technology.

Such an MEMS microphone may be manufactured by a semiconductor batch process. It may have a stronger humidity resistance and heat resistance than a conventional electret condenser microphone (ECM). Also, its size may become smaller and it may be integrated with a signal processing circuit.

The MEMS microphone may be classified into a piezoelectric MEMS microphone and a capacitive MEMS microphone.

The piezoelectric MEMS microphone includes only a vibration membrane. When the vibration membrane is deformed by an external sound pressure, an electrical signal is generated due to a piezoelectric effect. As a result, sound pressure is measured based on the electrical signal.

The capacitive MEMS microphone includes a fixing layer and a vibration membrane. When external sound pressure is applied to the vibration membrane, a capacitance value thereof is changed as an interval between the fixing layer and the vibration membrane is also changed.

In this case, the changed capacitance is outputted as a voltage signal, which corresponds to sensitivity, one of main performance indicators for the capacitive MEMS microphone.

To improve such sensitivity, reducing rigidity of the vibration membrane is desired.

SUMMARY

Some forms of the present disclosure provide a microphone including: a substrate having an acoustic hole; a vibrating electrode disposed on the substrate; and a fixing layer disposed on the vibrating electrode and to be formed so that a central portion thereof corresponding to the acoustic hole of the substrate is upwardly convex.

An edge of the vibrating electrode may be bonded to the substrate with an oxide layer therebetween.

The fixing layer may include a back plate formed on the vibrating electrode, and a fixed electrode supported by the back plate at an upper portion of the back plate.

The fixing layer may be formed to have a flat edge and a curved central portion with a dome shape.

A plurality of through-holes may be formed in the fixing layer at a position corresponding to the acoustic hole.

An electrode hole through which the vibrating electrode is exposed may be formed to penetrate one side of the edge of the fixing layer.

In some forms of the present disclosure, it is possible to improve sensitivity by forming a central portion of a fixed electrode to have a dome shape which is upwardly convex so that a distance between a vibrating electrode and the fixed electrode may be uniformly maintained throughout when a vibrating electrode vibrates.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
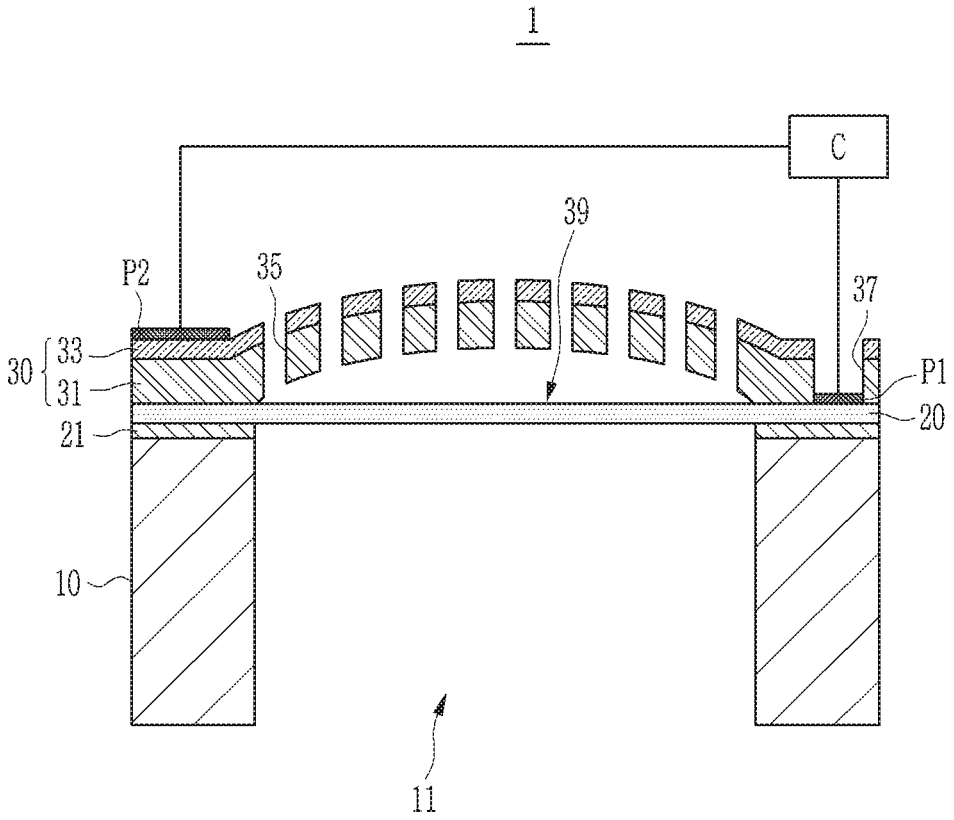
FIG. 1 illustrates a schematic diagram of a microphone.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

FIG. 1 illustrates a schematic diagram of a microphone in some forms of the present disclosure.

A microphone 1 in some forms of the present disclosure, which corresponds to a capacitive MEMS microphone, will now be described.

Referring to FIG. 1, the microphone 1 includes a substrate 10, a vibrating electrode 20, and a fixing layer 30.

An acoustic hole 11 is formed at a central portion of the substrate 10, and the substrate 10 may be made of a silicon wafer.

The acoustic hole 11 is a passage through which a sound is inputted from an external sound processing device (not shown).

In this case, the sound processing device processes sound of a user, and may be at least one of a sound recognition device, a hands-free apparatus, and a portable communication terminal.

The sound recognition device, when a user inputs a command thereto, recognizes and performs the command.

The hands-free apparatus is connected to a portable communication terminal through short-range wireless communication such that a user may freely talk without holding the portable communication terminal with a hand.

The portable communication terminal may communicate wirelessly, and it may be a smartphone, a personal digital assistant (PDA), or the like.

The vibrating electrode 20 is positioned on the substrate 10.

An edge of the vibrating electrode 20 is bonded to the substrate 10 with an oxide layer 21 therebetween.

The vibrating electrode 20 covers the acoustic hole 11 of the substrate 10.

In other words, some of the vibrating electrode 20 is exposed by the acoustic hole 11.

Some of the vibrating electrode 20 exposed by the acoustic hole 11 vibrates depending on a sound transmitted from a sound processing device.

The vibrating electrode 20 may be formed to have a circular flat shape.

The vibrating electrode 20 may be made of a polysilicon material, but is not limited thereto, and may be made of a conductive material.

The fixing layer 30 is disposed on the vibrating electrode 20.

The fixing layer 30 includes a back plate 31 and a fixed electrode 33.

In this case, the back plate 31 may be made of a silicon nitride material, but is not limited thereto, and may be made of various materials as necessary.

The back plate 31 is disposed between the vibrating electrode 10 and the fixed electrode 33 to insulate the vibrating electrode 10 from the fixed electrode 33.

In addition, the back plate 31 is disposed below the fixed electrode 33 to support the fixed electrode 33.

The fixed electrode 33 may be made of a polysilicon material like the vibrating electrode 20, but is not limited thereto, and may be made of a conductive material.

The fixing layer 30, which includes the back plate 31 and the fixed electrode 33, is provided with a central portion that corresponds to the acoustic hole 11 of the substrate 10 and is upwardly convex.

In other words, an edge of the fixing layer 30 is bonded to the vibrating electrode 20 to be flat, and the central portion thereof is formed to have a curved dome shape.

The fixing layer 30 is formed to have the dome shape, and is spaced apart from the vibrating electrode 20 by a predetermined distance.

A space formed by the predetermined distance forms an air layer 39.

When a sound source is inputted such that the vibrating electrode 20 vibrates, the air layer 39 prevents the vibrating electrode 20 from contacting the back plate 31.

A plurality of through-holes 35 are formed in a portion of the fixing layer 30 corresponding to the acoustic hole 11.

The through-holes 35 are passages through which a sound source is inputted from a sound processing device.

When the microphone 1 having the above-described structure receives a sound source through the acoustic hole 11 and through-hole 35 from a sound processing device, the sound source stimulates the vibrating electrode 20, thus the vibrating electrode 20 vibrates.

As the vibrating electrode 20 vibrates, a distance between the vibrating electrode 20 and the fixing layer 30 is varied.

In other words, as the vibrating electrode 20 vibrates, a distance between the vibrating electrode 20 and the fixed electrode 33 is varied.

Thus, a capacitance value between the vibrating electrode 20 and the fixed electrode 33 is changed, and an external signal processing circuit C receives the changed capacitance value through a first electrode pad P1 connected to the vibrating electrode 20 and a second electrode pad P2 connected to the fixed electrode 33 to convert it into an electrical signal, thereby detecting sensitivity.

In this case, the first electrode pad P1 and the second electrode pad P2 may be made of a metal material.

FIG. 2 to FIG. 9 illustrate sequential processing diagrams of a manufacturing method for manufacturing a microphone in some forms of the present disclosure.

Figure 2:
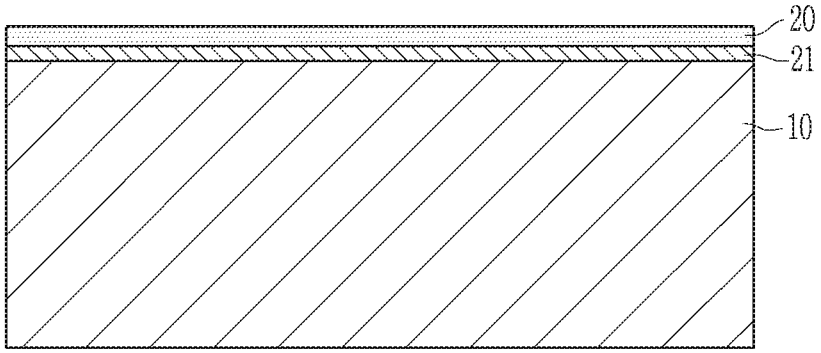
FIG. 2 to FIG. 9 illustrate sequential processing diagrams of a manufacturing method for manufacturing a microphone.

Referring to FIG. 2, first, the substrate 10 is prepared.

The substrate 10 may be a silicon wafer.

The oxide layer 21 is formed on the substrate 10.

In this case, the oxide layer 21 serves to prevent the substrate 10 from being oxidized.

Next, the vibrating electrode 20 is formed on the oxide layer 21.

The vibrating electrode 20 may be made of a polysilicon material.

Figure 3:
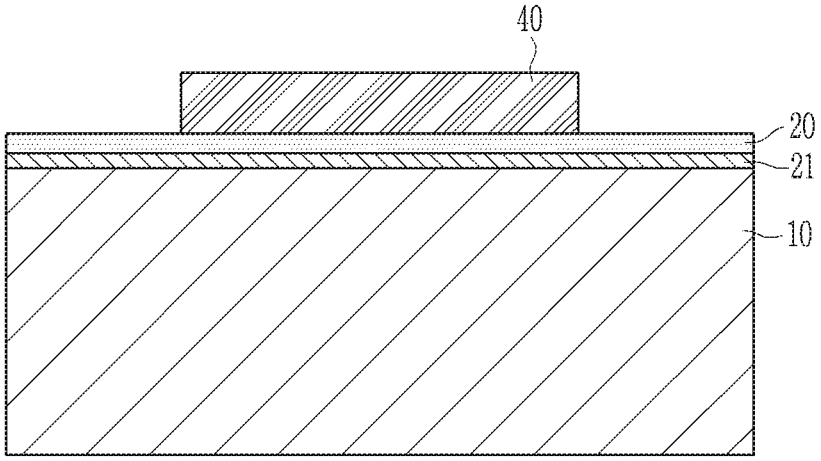

Referring to FIG. 3, a support layer 40 is formed on an entire upper portion of the vibrating electrode 20.

The support layer 40 may be made of an aluminum material.

Next, an edge of the support layer 40 except for a predetermined central region thereof is etched by patterning the support layer 40.

Figure 4:
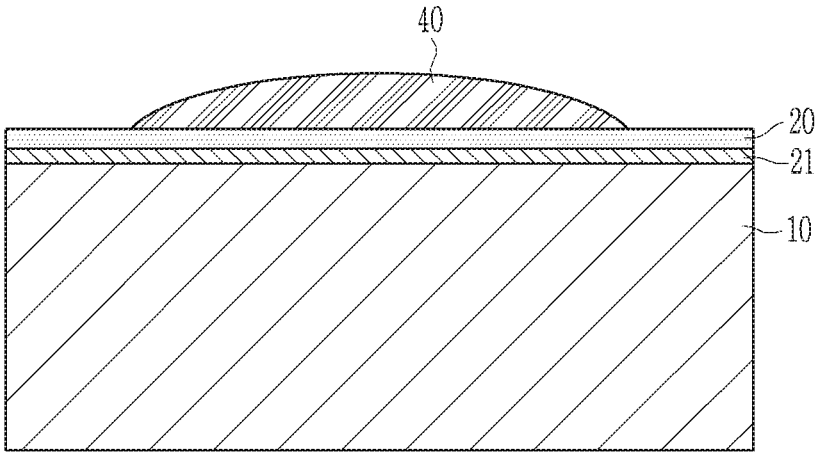

Referring to FIG. 4, a surface of the support layer 40 remaining in the predetermined central region is curved through a heating process to have a convex dome shape.

In this case, the heating process is a general process of melting a metal by applying heat thereto, so a detailed description thereof will be omitted.

Figure 5:
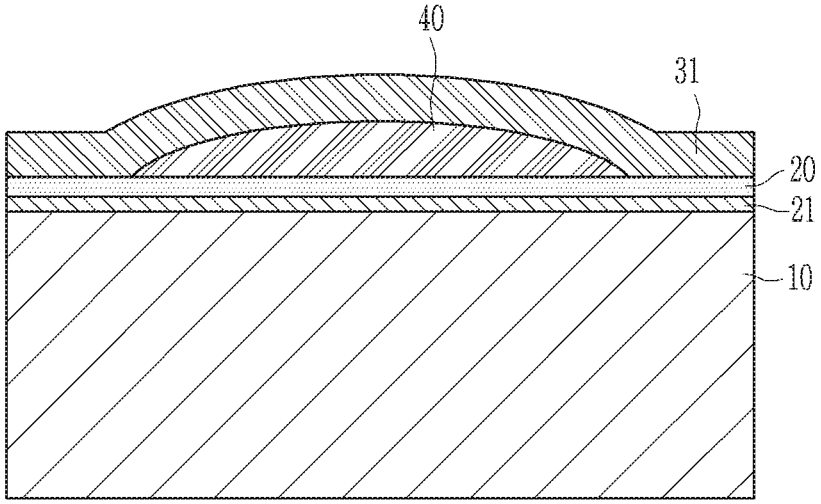
Figure 6:
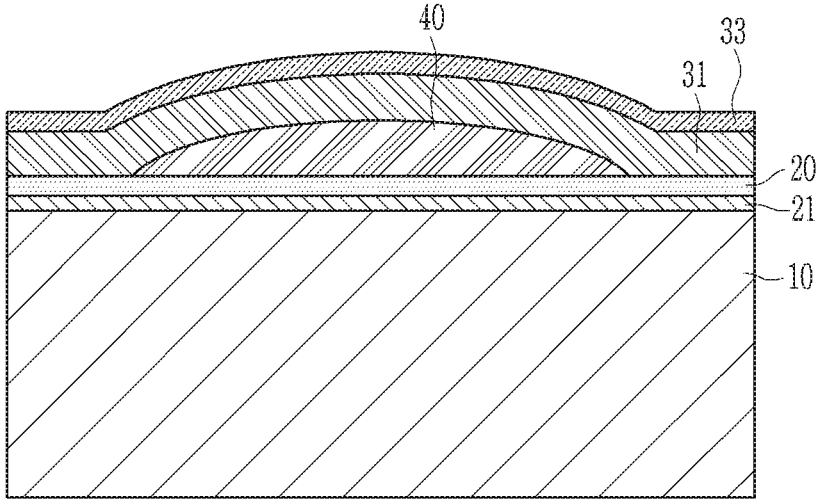

Referring to FIG. 5 and FIG. 6, the fixing layer 30 is formed on the vibrating electrode 20 and the support layer 40.

In this case, describing the process of forming the fixing layer 30 including the back plate 31 and the fixed electrode 33 in more detail, the back plate 31 is formed on the vibrating electrode 20 and the support layer 40.

Since the back plate 31 is formed on the vibrating electrode 20 and on an entire upper region of the support layer 40, an edge of the back plate 31 in which the support layer 40 is not present contacts the vibrating electrode 20 to have a flat shape, and a portion of the back plate 31 corresponding to the support layer 40 has a dome shape that is upwardly convex according to the dome shape of the support layer 40.

The back plate 31 may be made of a silicon nitride material.

Next, the fixed electrode 33 is formed on the back plate 31.

Similar to the shape of the back plate 31, the fixed electrode 33 has a flat edge and a dome shape with a curved central portion.

The fixed electrode 33 may be made of a polysilicon material.

Figure 7:
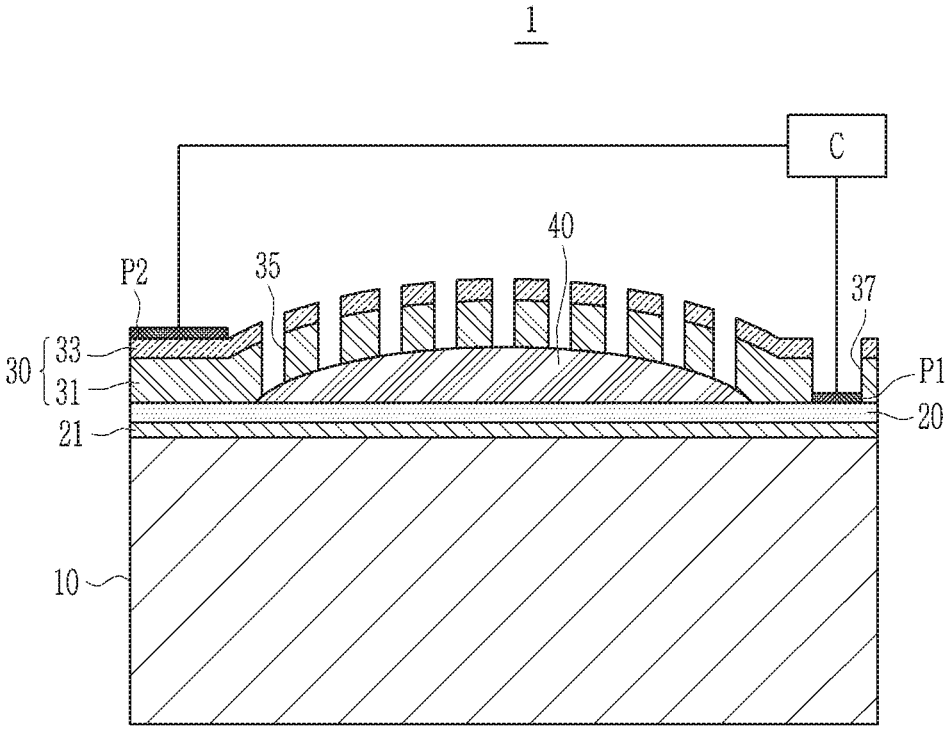

Referring to FIG. 7, the plurality of through-holes 35 are formed in the fixing layer 30 corresponding to the support layer 40.

The through-holes 35 are passages through which a sound source flows in from a sound processing device.

Next, an electrode hole 37 is formed in one side of the edge of the fixing layer 30 for the vibrating electrode 20 to be exposed.

The electrode hole 37 is formed so that the vibrating electrode 20 may be electrically connected to the external signal processing circuit C.

In this case, the first electrode pad P1 and the second electrode pad P2 are respectively formed on the exposed vibrating electrode 20 and on one side of the fixed electrode 33.

The first electrode pad P1 and the second electrode pad P2 are made of a metal material, and electrically connect the vibrating electrode 20 and the fixed electrode 33 to the external signal processing circuit C, respectively.

Figure 8:
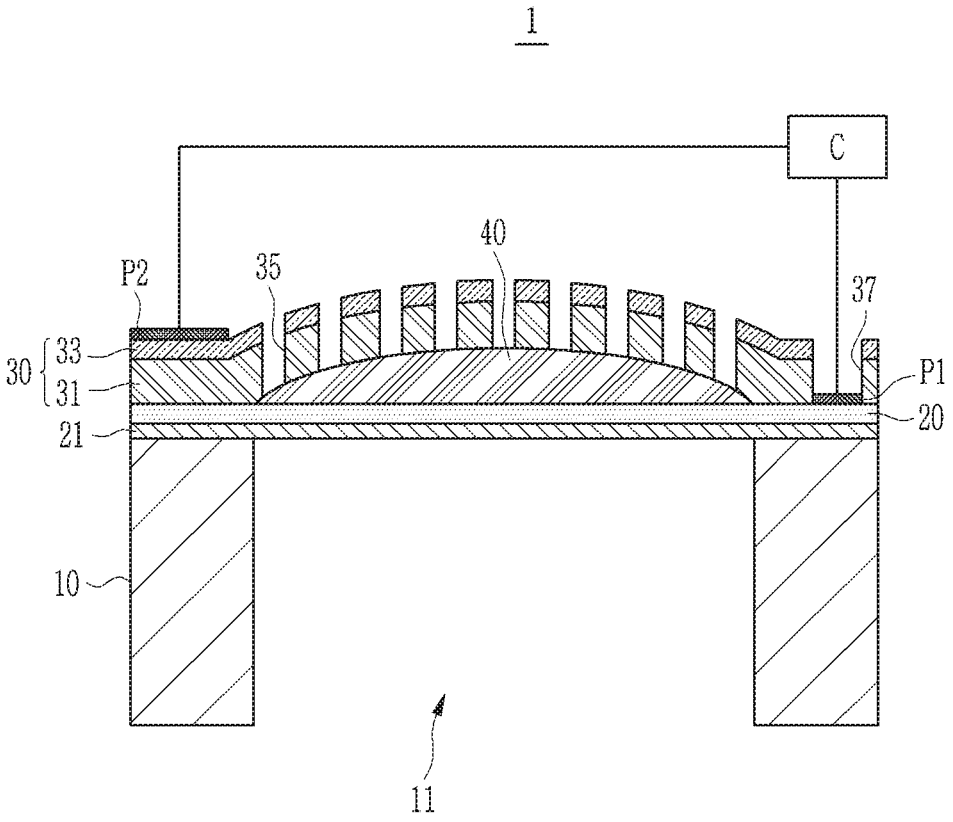

Referring to FIG. 8, a back surface of the substrate 10 is etched to form the acoustic hole 11.

The acoustic hole 11 is a passage through which a sound source generated from the sound processing device is inputted.

Figure 9:
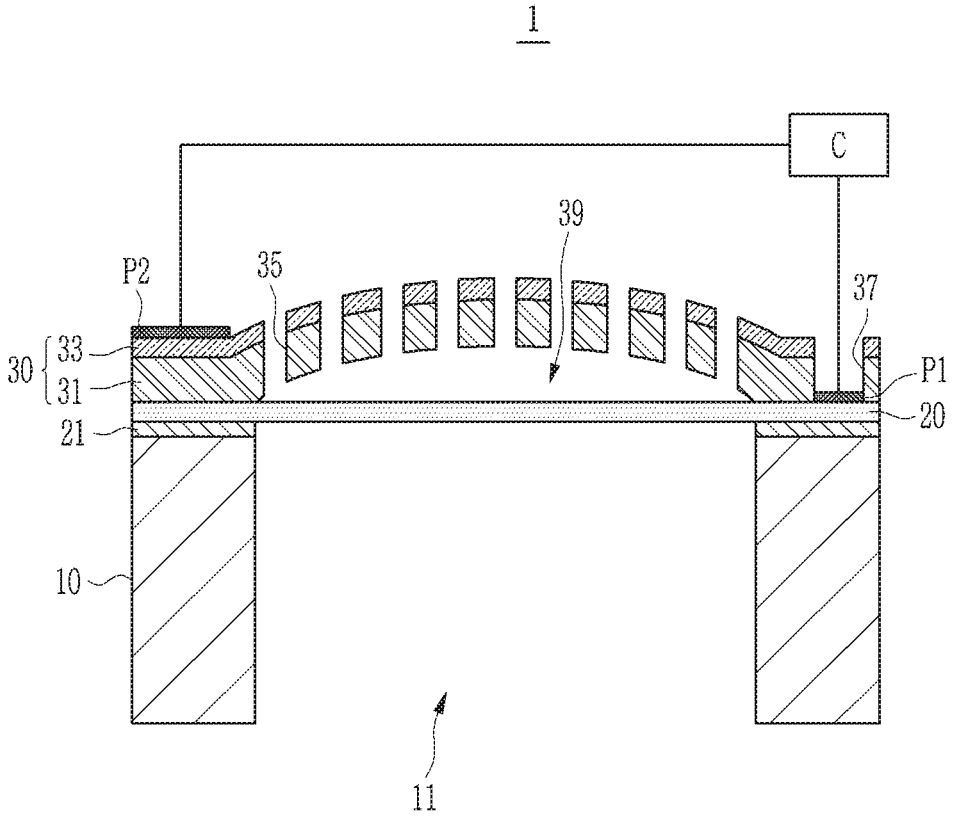

Referring to FIG. 9, a portion of the oxide layer 21 corresponding to the acoustic hole 11 of the substrate 10 is etched.

Next, the support layer 40 is removed.

In this case, the support layer may be removed by an aluminum removing agent.

As described above, a sensitivity of the microphone 1 may be calculated by Equation 1.

$$S(\text{Sensitivity}) = \frac{V_0}{h_g} S \frac{\times d}{\times P} S\left(\frac{1}{1+\frac{C_p}{C_0}}\right) \quad \text{[Equation 1]}$$

In Equation 1, V0 is a fixed bias voltage, hg is a distance between the vibrating electrode 20 and the fixed electrode 33, d is a changed distance between the vibrating electrode 20 and the fixed electrode 33, P is 1 Pa that is fixed by change of pressure, Cp is a parasitic capacitance of portions excluding a portion between the vibrating electrode 20 and the fixed electrode 33, and C0 is an initial capacitance.

According to Equation 1, as the initial capacitance C0 increases, the sensitivity of the microphone 1 may be improved.

In addition, the sensitivity of the microphone 1, as the changed distance d between the vibrating electrode 20 and the fixed electrode 33 increases, may be improved.

In this case, the changed distance between the vibrating electrode 20 and the fixed electrode 33 may be explained by Equation 2.

Equation 2 is an equation representing an attractive force due to an electrostatic force generated in the microphone 1.

$$F_e = \frac{\varepsilon A V^2}{2g^2} \quad \text{[Equation 2]}$$

In Equation 2, ε denotes permittivity, A denotes an effective area, V denotes a bias voltage, and g denotes a distance between the vibrating electrode 20 and the fixed electrode 33.

Generally, when the bias voltage is applied between the vibrating electrode 20 and the fixed electrode 33, the attractive force due to the electrostatic force is generated in the microphone 1.

In Equation 2, since the attractive force is inversely proportional to the square of the distance between the vibrating electrode 20 and the fixed electrode 33, the smaller the distance between the vibrating electrode 20 and the fixed electrode 33, the greater the attractive force therebetween.

That is, in the microphone 1 in some forms of the present disclosure, when the vibrating electrode 20 vibrates by the fixed electrode 33 with the dome shape, since the attractive force generated between the vibrating electrode 20 and the fixed electrode 33 is generally uniform and great, a vibration displacement of the vibrating electrode 20 increases.

Accordingly, the changed distance d between the vibrating electrode 20 and the fixed electrode 33 increases, thus the sensitivity is improved according to Equation 1.

Figure 10:
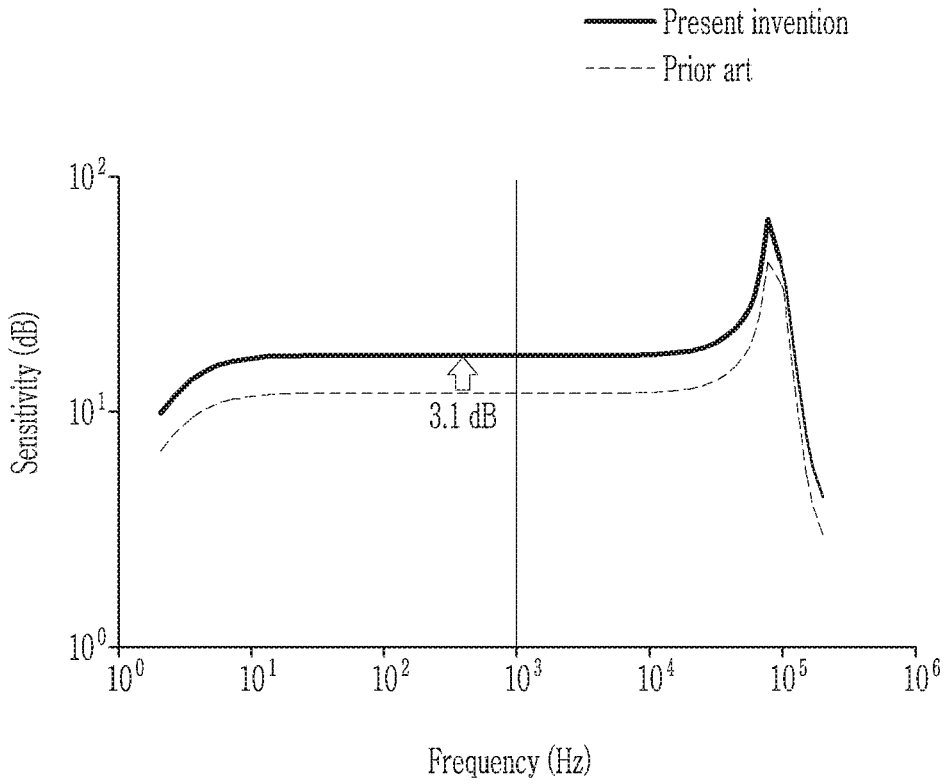
FIG. 10 illustrates a graph analyzing sensitivity of a microphone.

FIG. 10 illustrates a result graph of analyzing the sensitivity of the microphone in some forms of the present disclosure.

FIG. 10 illustrates results of analyzing the sensitivity of the microphone when a frequency and a pressure applied to the microphone are respectively about 1 KHz and about 1 Pa, and the microphones in some forms of the present disclosure and the prior art are compared in FIG. 10. In the prior art, a vibrating electrode and a fixed electrode are parallel.

When comparing the microphone 1 in some forms of the present disclosure and the microphone according to the prior art, the sensitivity of the microphone 1 in some forms of the present disclosure is improved by about 3.1 dB, that is, is about 1.4 times that of the prior art.

In some forms of the present disclosure, the fixed electrode 33 is formed to have the dome shape of which the central portion is upwardly convex, thus the distance between the vibrating electrode 20 and the fixed electrode 33 is maintained to be generally uniform when the vibrating electrode 20 vibrates, thereby improving the sensitivity of the microphone.

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A microphone comprising:

a substrate having an acoustic hole;

a vibrating electrode disposed on the substrate; and a fixing layer disposed on the vibrating electrode, wherein a central portion of the fixing layer corresponding to the acoustic hole of the substrate is formed upwardly convex, wherein the fixing layer is formed to have a flat edge and a curved central portion with a dome shape such that a changed distance between the vibrating electrode and the fixing layer increases when the vibrating electrode vibrates to improve sensitivity of the microphone.

2. The microphone of claim 1, wherein:

an edge of the vibrating electrode is bonded to the substrate with an oxide layer therebetween.

3. The microphone of claim 1, wherein the fixing layer comprises:

a back plate formed on the vibrating electrode; and a fixed electrode supported by the back plate at an upper portion of the back plate.

4. The microphone of claim 3, wherein:

a plurality of through-holes is formed in the fixing layer at a position corresponding to the acoustic hole.

5. The microphone of claim 3, wherein:

an electrode hole is formed to penetrate one side of the fixing layer, wherein the vibrating electrode is exposed through the electrode hole.

6. A manufacturing method of a microphone comprising:

forming a vibrating electrode on an upper surface of a substrate;

forming a support layer, wherein the support layer is partially formed on the vibrating electrode and a central portion of the support layer is formed upwardly convex;

forming a fixing layer, wherein a central portion of the fixing layer is formed upwardly convex at the vibrating electrode and the support layer; and forming an acoustic hole by etching a back surface of the substrate, wherein forming the fixing layer comprises:

forming a back plate on the vibrating electrode and on an entire upper region of the support layer;

forming a fixed electrode on the back plate; and forming the back plate and the fixed electrode, wherein each of the back plate and the fixed electrode is formed to have a flat edge and a curved central portion with a dome shape such that a changed distance between the vibrating electrode and the fixing layer increases when the vibrating electrode vibrates to improve sensitivity of the microphone.

7. The manufacturing method of the microphone of claim 6, wherein forming the vibrating electrode comprises:

forming an oxide layer on the substrate; and forming the vibrating electrode on the oxide layer.

8. The manufacturing method of the microphone of claim 6, wherein forming the support layer comprises:

etching an edge of the support layer except for some of the central portion of the support layer formed on the vibrating electrode; and forming the support layer to have a curved shape by applying heat to some of the central portion of the support layer.

9. The manufacturing method of the microphone of claim 8, wherein forming the support layer comprises:

forming the support layer made of an aluminum material.

10. The manufacturing method of the microphone of claim 6, where after the fixing layer is formed, the manufacturing method further comprises:

forming a plurality of through-holes penetrating the fixing layer corresponding to the support layer; and forming an electrode hole penetrating one side of the fixing layer.

11. The manufacturing method of the microphone of claim 6, where after the acoustic hole is formed, the manufacturing method further comprises:

etching the oxide layer corresponding to the acoustic hole; and removing the support layer.

12. The manufacturing method of the microphone of claim 11, wherein removing the support layer comprises:

using a metal removing agent.

* * * * *